US008342423B2

(12) United States Patent
Bowers et al.

(10) Patent No.: US 8,342,423 B2
(45) Date of Patent: Jan. 1, 2013

(54) FUEL INJECTION APPARATUS

(75) Inventors: Stephen K. Bowers, Middlesex (GB); Anthony T Harcombe, Richmond (GB)

(73) Assignee: Delphi Technologies Holding S.arl, Troy, MI (US)

( * ) Notice: Subject to any disclaimer, the term of this patent is extended or adjusted under 35 U.S.C. 154(b) by 628 days.

(21) Appl. No.: 11/794,779

(22) PCT Filed: Dec. 14, 2005

(86) PCT No.: PCT/GB2005/004804

§ 371 (c)(1),
(2), (4) Date: Jul. 3, 2007

(87) PCT Pub. No.: WO2006/072757

PCT Pub. Date: Jul. 13, 2006

(65) Prior Publication Data

US 2009/0072054 A1 Mar. 19, 2009

(30) Foreign Application Priority Data

Jan. 7, 2005 (EP) ..... 05250052

(51) Int. Cl.

| | |
|---|---|
| ***F02M 47/02*** | (2006.01) |
| ***F02M 57/02*** | (2006.01) |
| ***B05B 9/00*** | (2006.01) |
| ***B05B 1/30*** | (2006.01) |

(52) U.S. Cl. ..... 239/90; 239/88; 239/91; 239/124; 239/126; 239/569; 123/446

(58) Field of Classification Search ..... 239/88, 239/90, 91, 124, 126, 127, 533.8, 533.9, 239/569, 585.1; 123/446, 467
See application file for complete search history.

(56) References Cited

U.S. PATENT DOCUMENTS

| | | | | |
|---|---|---|---|---|
| 5,524,826 | A * | 6/1996 | Mueller et al. | 239/88 |
| 5,842,640 | A * | 12/1998 | Ganser | 239/89 |
| 5,984,200 | A * | 11/1999 | Augustin | 239/88 |
| 6,405,941 | B2 * | 6/2002 | Ganser | 239/88 |
| 6,991,179 | B2 * | 1/2006 | Scheibe et al. | 239/96 |

* cited by examiner

*Primary Examiner* — Len Tran
*Assistant Examiner* — Ryan Reis
(74) *Attorney, Agent, or Firm* — Mark H. Svoboda

(57) ABSTRACT

A fuel injection apparatus for an internal combustion engine includes a fuel supply passage and a valve arrangement for controlling fuel pressure within the fuel supply passage. The valve arrangement includes a valve member movable between an open position in which the fuel supply passage communicates with a low pressure fuel drain and a closed position in which communication between the fuel supply passage and the low pressure fuel drain is prevented. The valve arrangement comprises damping means for controlling and/or damping movement of the valve member between the closed and open positions.

11 Claims, 7 Drawing Sheets

FUEL INJECTION APPARATUS

TECHNICAL FIELD

The present invention relates to a fuel injection apparatus for the delivery of fuel to a combustion space of an internal combustion engine. The fuel supply system includes a drain valve arrangement for controlling fluid pressure within a delivery chamber forming part of the fuel injection apparatus. In particular, but not exclusively, the invention is concerned with controlling the rate at which fluid pressure within the delivery chamber is reduced during termination of injection.

BACKGROUND TO THE INVENTION

It is known, for example from European Patent No EP0987431 in the name of Delphi Technologies Inc., to provide a fuel injector with two independently operable valve arrangements for controlling fluid pressure within the injector. The valve arrangements are arranged to control movement of a fuel injector valve needle relative to a valve needle seating so as to control the delivery of fuel from the injector. Movement of the valve needle away from the seating permits fuel to flow from the injector delivery chamber through one or more outlet openings of the injector into the engine or other combustion space.

A first one of the valve arrangements, known as a control valve arrangement or nozzle control valve, includes a control valve member which is movable between a first position in which fuel under high pressure is able to flow from a fuel supply passage into a control chamber, and a second position in which the control chamber communicates with a low pressure fuel reservoir. A surface associated with the valve needle is exposed to fuel pressure within the control chamber such that the pressure of fuel within the control chamber applies a force to the valve needle to urge the valve needle towards its seating, thereby closing the outlet openings. In this position, injection of fuel into the engine or other combustion space does not occur.

In order to commence injection, the control valve arrangement is actuated such that the control valve member is moved into its second position, thereby causing fuel pressure within the control chamber to be reduced. The force urging the needle towards its seating is therefore reduced and fuel pressure within the delivery chamber acts on thrust surfaces of the valve needle to lift the valve needle away from its seating to permit fuel to flow through the injector outlet openings.

In order to terminate injection, the control valve arrangement may be actuated such that the control valve member is moved into its first position, thereby permitting fuel under high pressure to flow from the fuel supply passage into the control chamber. The force acting on the valve needle due to fuel pressure within the control chamber is therefore increased, causing the valve needle to be urged against its seating to terminate injection.

It can be seen that the control valve arrangement is therefore operable effectively to control the pressure differential between the fuel in the control chamber and the fuel in the delivery chamber, that is to say the differential in the pressure acting to close the needle and the pressure serving to open it. In addition to the pressure of fuel in the control chamber tending to urge the valve needle to close, a closing spring is usually provided to assist the aforementioned closing force.

Another method of terminating injection is to use the second valve arrangement, often known as a "spill valve" or "drain valve". The drain valve includes a drain valve member which is movable within a bore formed in a drain valve housing between a first, closed position in which pressurised fuel is able to flow from a high pressure fuel source, such as a fuel pump, to the fuel supply passage and the delivery chamber and a second, open position in which the fuel supply passage communicates with the low pressure fuel reservoir.

Movement of the drain valve to its open position causes fuel to flow from the fuel supply passage and the delivery chamber to the low pressure reservoir such that fuel pressure within the fuel supply passage and the delivery chamber is reduced. The resulting pressure differential between the control chamber and the delivery chamber urges the valve needle against its seating, closing the outlet openings in the injector body and terminating injection.

Movement of the drain valve member between the first and second positions is frequently achieved by means of an electromagnetic actuator and spring arrangement. Energisation of the actuator causes the drain valve member to move into the first, closed position whilst de-energising of the actuator causes the drain valve member to move into the second, open position under the influence of the spring.

Since the actuator is de-energised in order to move the drain valve member into the second position, there is little or no control of the movement of the drain valve member, which movement is determined mainly by the rate of the spring. As a result, the drain valve member is opened at a relatively high speed.

This high speed opening of the drain valve member has been shown to have an adverse effect on the structural integrity of the drain valve. Specifically, the abrupt contact between the drain valve member and the end wall or "stop face" of the drain valve housing exerts high stresses on the drain valve member which can fracture or distort. In addition, injector noise may be relatively high.

It is an aim of the invention to provide an improved valve arrangement which addresses some or all of the problems mentioned above or an injector having such an improved valve arrangement.

SUMMARY OF THE INVENTION

According to one aspect of the present invention, therefore, there is provided a fuel injection apparatus, such as a fuel injector, including a fuel supply passage and a valve arrangement for use in controlling fuel pressure within the fuel supply passage. The valve arrangement includes a valve member movable between an open position in which the fuel supply passage communicates with a low pressure fuel drain and a closed position in which communication between the fuel supply passage and the low pressure fuel drain is prevented, characterised in that the valve arrangement comprises damping means for controlling and/or damping movement of the valve member between the closed and open positions.

Advantageously, controlling or damping the movement of the valve member between the closed and open positions enables the velocity of the valve member in the opening direction (also referred to as the 'opening velocity') to be reduced, thereby reducing stresses placed on the valve member and reducing injector noise. In other words, the 'spill rate' of the injector can be controlled.

In one embodiment, the valve member is movable within a bore disposed in a housing, the bore being closed at one end thereof. Preferably, the damping means comprises a damping chamber consisting of a volume defined between the closed end of the bore and the valve member, the damping chamber having an exit or outlet for controlling the rate of fuel flow into and/or out of the damping chamber thereby to provide a damping effect on the valve member.

The exit or outlet may comprise a drain slot and may include means for hindering or restricting flow of fuel from the damping chamber. The means for hindering or restricting flow of fuel from the damping chamber may comprise a narrowing or a restriction in the drain slot.

In one embodiment, movement of the valve member towards the closed end of the bore causes the pressure of fuel in the damping chamber to increase thereby to limit the velocity of the valve member within the bore.

The fuel injection apparatus may further comprise collection means for hindering or substantially preventing fuel leakage between the valve member and the bore from entering into the damping chamber. The collection means may comprise a volume for collecting fuel leaking between the valve member and the bore.

In one embodiment, the volume comprises an annular chamber formed in the valve member. In another embodiment, the volume comprises an annular recess formed in the wall of the bore. The volume may be in fluid communication with the low pressure drain, for example via a drilling or the like.

In one example, the drilling may be provided in the housing for the valve member, or in another example the drilling may be provided in the drain valve member itself. For example, the valve member may be provided with an axial drilling and one or more radial drillings to provide communication between the volume and the low pressure drain.

The valve arrangement may further comprise drain means for draining away at least a proportion of the fuel which leaks into the damping chamber between the valve member and the bore.

In one embodiment, the drain means comprises a bore or passage extending through the valve member and being in communication with the low pressure fuel drain. In another embodiment, the drain means comprises a passage opening into the damping chamber and being in communication with the low pressure fuel drain. In this embodiment, the passage may comprise a first sump opening into the damping chamber, a second sump in communication with the low pressure fuel drain and an intermediate passage connecting the first and second sumps.

Advantageously, the arrangement may be such that movement of the valve member towards the closed end of the bore varies the effective area of the drain means thereby varying the drain path from the damping chamber to the low pressure drain.

In one embodiment the arrangement is such that the ratio between the effective area of the drain path and the rate of fuel leakage into the damping chamber past the valve member is maintained within a predetermined range. In another embodiment the arrangement is such that the ratio between the area of the flow path and the rate of fuel leakage into the damping chamber past the valve member is maintained substantially constant.

Advantageously, any pressure variation within the damping chamber due to fuel leakage past the valve member is effectively decoupled from the pressure variation within the damping chamber due to movement of the valve member between the closed and open positions. As a result, fuel contained within the damping chamber is able to act to damp or slow movement of the valve member between the first and second positions, thereby slowing the opening of the valve arrangement and reducing the spill rate of the injector.

BRIEF DESCRIPTION OF DRAWINGS

The present invention will now be described, by way of example only, with reference to the accompanying drawings in which.

In the following description references to the terms "up", "down", or derivatives thereof, are to be interpreted in relation to the orientation of the drawings and are used for illustrative purposes only.

DETAILED DESCRIPTION OF PREFERRED EMBODIMENTS

Figure 1:
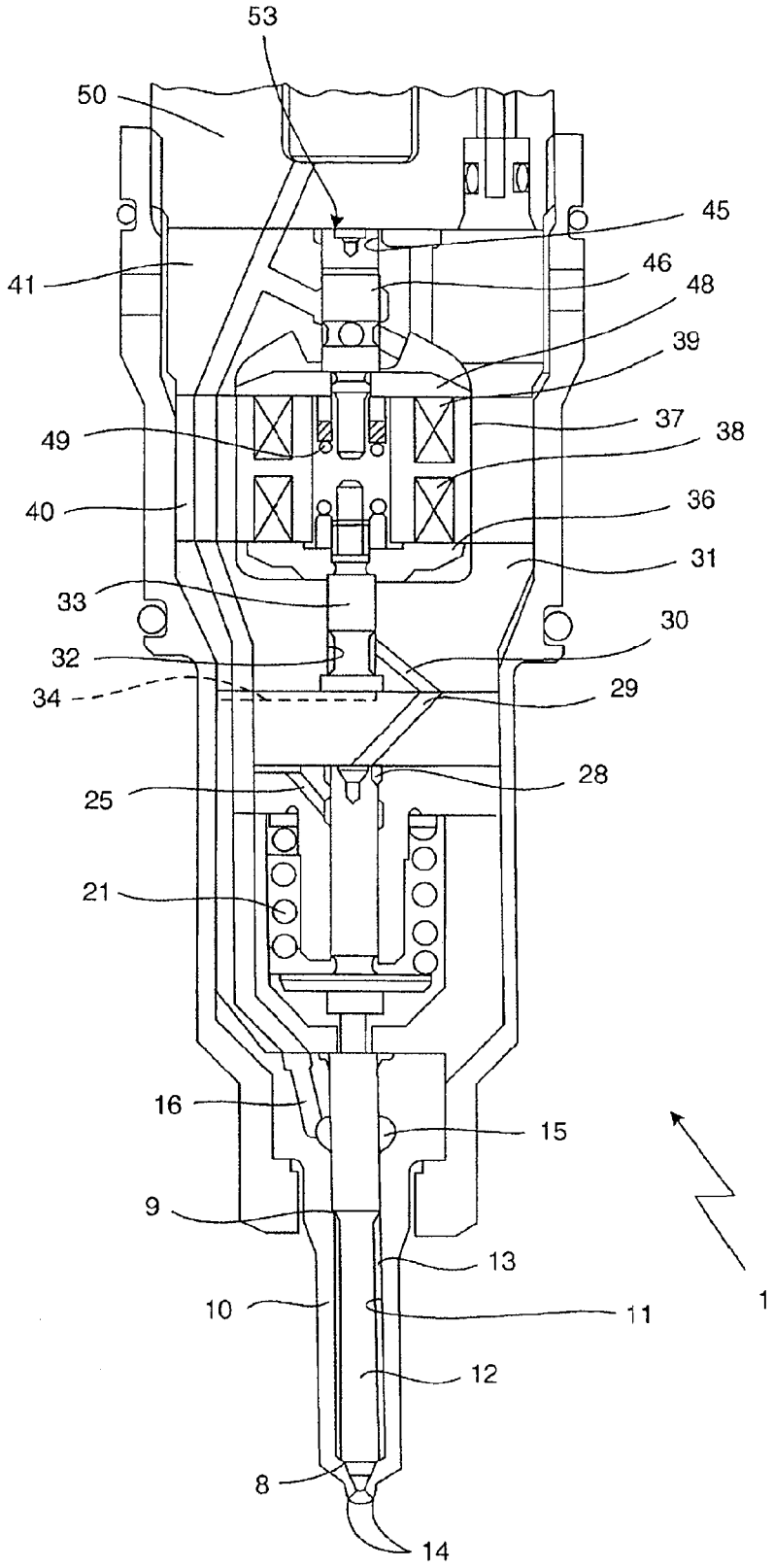
Figure 1 Prior Art
FIG. 1 is a sectional view through a known form of fuel injector.

Referring firstly to FIG. 1, a known unit pump injector for delivering fuel to an engine cylinder or other combustion space of an internal combustion engine is shown generally at 1. The injector 1 comprises a valve needle 12 which is slidable within a bore 11 formed in a nozzle body 10. The valve needle 12 is engageable with a valve needle seating 8 defined adjacent a blind end of the nozzle body bore 11 to control the flow of fuel from a delivery chamber 13, defined between the needle 12 and the nozzle body bore 11, to a plurality of outlet openings 14 located downstream of the valve needle seating 8.

The valve needle 12 is provided with angled thrust surfaces 9 which are exposed to fuel pressure within the delivery chamber 13. The arrangement is such that the application of fuel under high pressure to the delivery chamber 13 applies an upward force on the valve needle 12 which acts to urge the valve needle 12 away from its seating 8.

The bore 11 is shaped to define an annular chamber 15 to which fuel under high pressure is delivered from a fuel source, such as a high pressure fuel pump, through a supply passage 16 provided in the nozzle body 10. Flutes or other formations (not shown) are provided in the valve needle 12 to permit fuel to flow from the annular chamber 15 to the delivery chamber 13. The valve needle 12 further includes regions of diameter substantially equal to the diameter of the adjacent parts of the nozzle body bore 11 to guide the needle 12 for sliding movement within the bore 11.

The end of the valve needle 12 remote from the outlet openings 14 is exposed to fuel pressure within a control chamber 28 formed within the injector. The control chamber 28 communicates with the fuel supply passage 16 via a drilling 25 and fuel pressure within the control chamber 28 applies a downward force to the valve needle 12 which serves to urge the valve needle 12 against its seating 8.

In use, when high pressure fuel is supplied to the annular chamber 15 through the supply passage 16, and hence to the delivery chamber 13, an upward force is applied to the thrust surfaces 9 on the valve needle 12 which serves to urge the valve needle 12 away from the valve needle seating 8. If fuel pressure within the control chamber 28 is reduced sufficiently, the upward force acting on the valve needle 12 due to fuel pressure within the delivery chamber 13 is sufficient to overcome the downward force acting on the end surface of the valve needle 12 such that the needle lifts away from the valve needle seating 8 to commence fuel injection. Thus, by controlling fuel pressure within the control chamber 28, initiation and termination of fuel injection can be controlled.

The pressure of fuel within the control chamber 28 is controlled by means of a control valve arrangement which includes a control valve member 33 slidable within a bore 32 defined in a control valve housing 31 (herein referred to as the valve housing bore 32). The control chamber 28 further communicates with a drilling 30 formed in the control valve housing 31. The drilling 30 opens into the valve housing bore 32 and the control valve member 33 is slidable within the valve housing bore 32 to control communication between the drilling 30 and a groove 34. The groove 34 communicates with a low pressure fuel reservoir or drain.

The control valve member 33 carries an armature 36 which is moveable under the influence of the magnetic field generated, in use, by an actuator arrangement 37 including first and second windings 38, 39. The actuator arrangement 37 is located within an actuator housing 40 which abuts the control valve housing 31. A drain valve housing 41 abuts the surface of the actuator housing 40 remote from the control valve housing 31.

Figure 2:
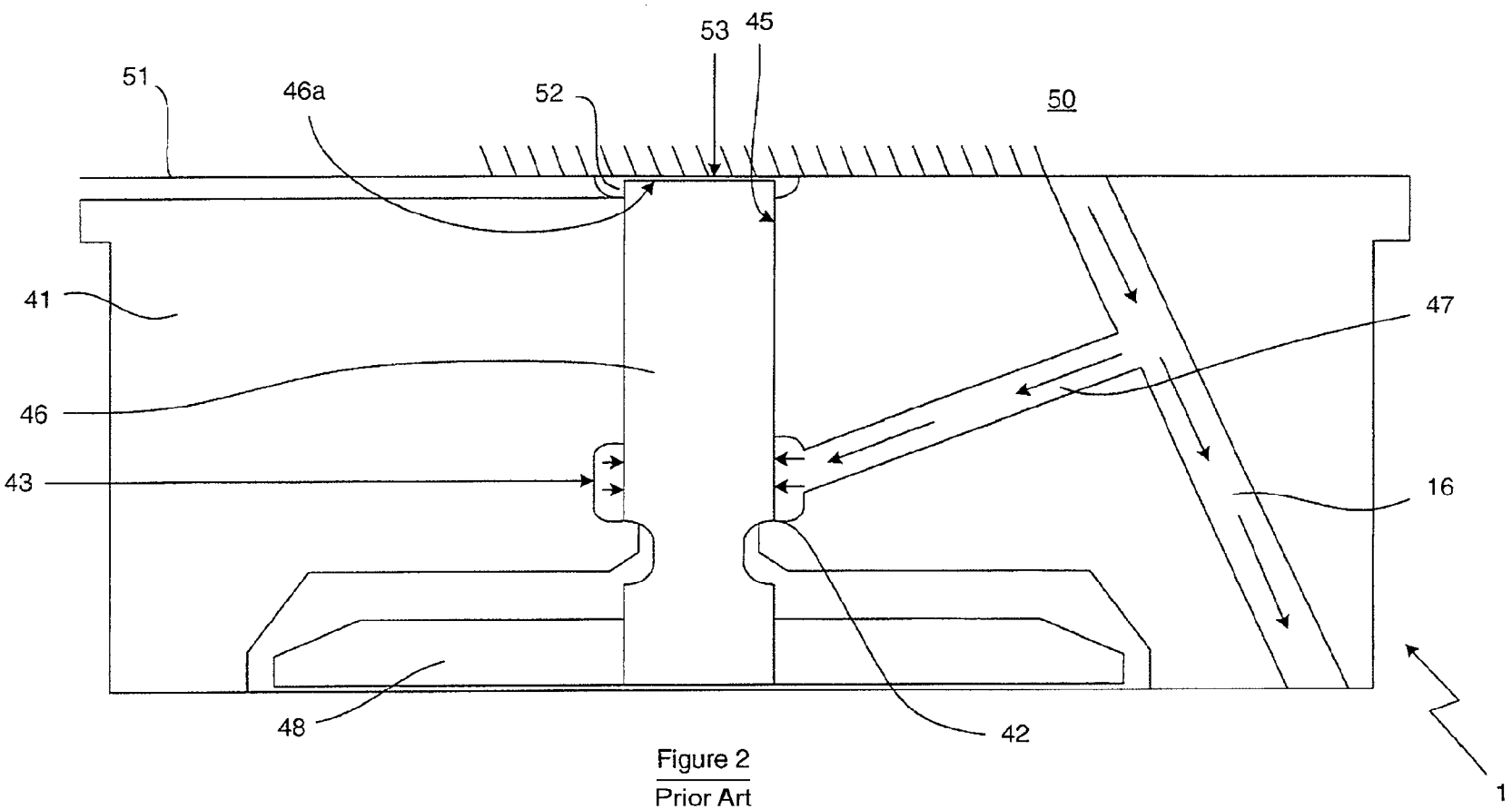
Figure 2 Prior Art
FIG. 2 is an enlarged sectional view of part of the fuel injector of FIG. 1.

Referring additionally to FIG. 2, the drain valve housing 41 includes a through bore 45 (herein referred to as the drain valve bore 45) within which a drain valve member 46 is slidable. The drain valve member 46 includes an end face 46*a*, at its uppermost end in FIG. 2, and includes what is commonly referred to as a valve pin or valve stem which forms the main body of the valve. One end of the drain valve bore 45 is closed by a pump housing 50 of the injector which defines a so-called "stop face" 53. The volume 52 defined between the end face 46*a* of the drain valve member 46 and the stop face 53 is known as the stop chamber and, in use, is usually filled with fuel leaking from the supply passage 16 past the drain valve member 46, between the outer surface of the drain valve member 46 and the inner surface of the drain valve bore 45.

Such leakage, often referred to as 'valve stem leakage', is generally undesirable but manufacturing tolerances mean that it is difficult to eliminate entirely. In order to prevent this accumulation of leaked fuel from restricting the displacement of the drain valve member 46, the stop chamber 52 communicates with the low pressure fuel reservoir via a drain slot 51 formed between the drain valve housing 41 and the pump housing 50.

The drain valve member 46 is engageable with a seating 42 to control communication between an annular gallery 43 formed within the drain valve housing 41 and the low pressure fuel reservoir, the annular gallery 43 being in communication with the supply passage 16 via a drilling 47.

The drain valve member 46 is secured to an armature 48 which is moveable under the influence of the magnetic field generated, in use, by the second winding 39 of the actuator arrangement 37 (as shown in FIG. 1). When the second winding 39 of the actuator arrangement 37 is energised, the drain valve member 46 is moved downwardly into its closed position in which it rests against the seat 42. On the other hand, when the second winding 39 is de-energised, a compression spring 49 disposed between the armatures 36, 48 serves to urge the drain valve member 46 upwardly into its open position.

Operation of the injector will now be described, starting from the position in which both the control valve member 33 and the drain valve member 46 are initially open, with both windings 38, 39 of the actuator arrangement 37 being de-energised. In this state, fuel from the high pressure source simply flows from the fuel supply passage 16, past the open drain valve member 46 to the low pressure drain or past the open control valve member 33 to the low pressure drain. Thus, neither the delivery chamber 13 nor the control chamber 28 are filled with high pressure fuel.

In order to commence injection, it is necessary to pressurise the fuel within the injector in order to achieve the desired injection pressure at the appropriate point in the delivery cycle. When such pressurisation is to commence, both windings 38, 39 of the actuator arrangement 37 are energised. This energizing of the windings causes the armatures 36, 48 to move towards one another, compressing the spring 49 and moving both the drain valve member 46 and control valve member 33 into engagement with their respective seatings, that is to say into their closed positions. As a result, fuel is neither able to flow past the drain valve member 46 to the low pressure drain, or past the control valve member 33 to the low pressure drain.

In this state, fuel at a high pressure is supplied from the high pressure fuel source to both the delivery chamber 13 and the control chamber 28 via the supply passage 16. At this time the downward force applied to the needle 12 by the fuel within the control chamber 28 (acting in combination with the valve needle spring, if provided) is greater than the upward force applied by the fuel within the delivery chamber 13. Thus, the valve needle 12 remains engaged with its seating 8.

In order to commence injection following pressurisation, the first winding 38 is de-energised, causing the control valve member 33 to move from its closed position to its open position under the influence of the spring 49. In this open position of the control valve member 33, the control chamber 28 is brought into communication with the low pressure fuel reservoir or drain and thus fuel pressure within the control chamber 28 is reduced. The armature 48 of the drain valve member 46 does not move, and so the drain valve member 46 remains in engagement with its seating 42.

A predetermined period after opening of the control valve member 33, the fuel pressure within the control chamber 28 reduces to a point where the downward force acting to urge the valve needle 12 towards its seating 8 falls sufficiently such that the upward force applied by high pressure fuel within the delivery chamber 13 acting on the thrust surfaces 9 exceeds it. As a result, the valve needle 12 is urged away from its seating 8. As the valve needle 12 lifts away from its seating 8, the high pressure fuel within the delivery chamber 13 is expelled through the outlet openings 14 in the blind end of the bore 11 in the needle housing 10, thereby to commence injection.

In order to terminate injection, the second winding 39 of the actuator 37 is totally de-energized, and as a result the drain valve member 46 is able to move away from its seating 42 under the action of the spring 49, and into its open position. This movement permits fuel to flow past the drain valve member 46 and escape to the low pressure drain reservoir. As a result, the fuel pressure within the delivery chamber 13 begins to fall and, after a predetermined period, reduces to an extent sufficient to allow the spring 21 to return the needle 12 into engagement with its seating 8, thus terminating the supply of fuel to the outlet openings 14 and terminating injection. The injector shown in FIGS. 1 and 2 is well known, for example from European Patent No. EP0987431.

The present applicants have identified that it is desirable to control the rate of opening of the drain valve member 46 and, specifically, to reduce the speed at which the drain valve member 46 moves between its closed and open positions. The applicants propose that there are a number of reasons why reducing the drain valve opening velocity may be advantageous.

Firstly, owing to the requirement for a safety mechanism within the injector to prevent overpressure, an imbalance is built into the drain valve member 46 which is arranged to blow open at a predetermined pressure. This imbalance significantly increases valve velocity as a function of pressure and this has been shown to compromise the integrity of the interface between the drain valve armature 48 and the body (also known as the "pin" or "stem") of the drain valve member 46.

Also, a high opening velocity of the drain valve member 46 naturally results in a high "spill rate" which has been identified as contributing significantly to the hydraulic noise generated by the injector.

Furthermore, for close-coupled post injection at low pressure, it is highly desirable to inject the post fuel during the decaying pressure at the end of injection. If the spill rate is too high, the fuel pressure within the delivery chamber 13 can drop too rapidly to permit the valve needle 12 to be lifted a second time in order to carry out the post injection.

In one embodiment, the present invention involves using the stop chamber 52, disposed between the stop face 53 of the drain valve bore 45 and the end face 46*a* of the drain valve member, as a damping chamber whereby fuel within the chamber 52 is used to damp or slow movement of the drain valve member 46 itself. In prior art injectors, as described above, the stop chamber 52 has been provided with a drain slot 51, in communication with the low pressure fuel reservoir. The provision of the drain slot 51 permits the leaked fuel to flow, in a substantially unrestricted manner, to the low pressure drain. As a result, there is no damping effect on the valve member 46, which therefore suffers from the above-described problems associated with excessive valve opening velocity.

Figure 3:
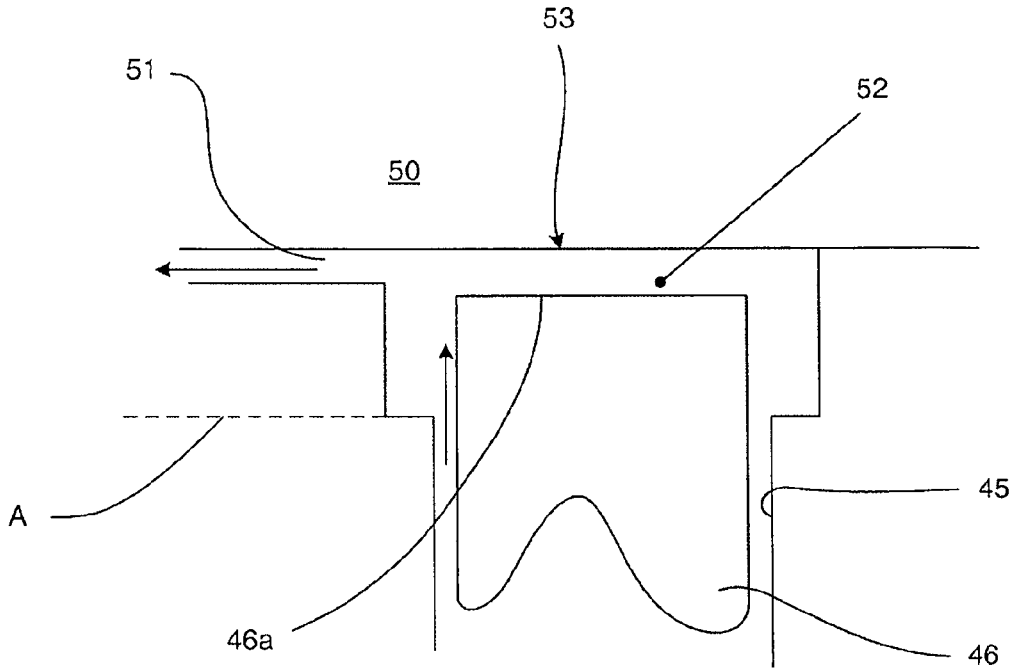
FIG. 3 is a sectional view through a valve arrangement embodying a first form of the invention.

As illustrated in the exemplary embodiment of FIG. 3, which is a sectional view through a drain valve arrangement embodying a first form of the invention, the cross sectional area of the drain slot 51 is reduced, at least along a part of its length, to restrict the flow of fuel into and out of the stop chamber 52. The dotted line A in FIG. 3 represents illustratively the diameter of the known drain slot so as to illustrate clearly that the invention provides a drain slot which, in comparison, is reduced in diameter.

By providing such a restriction in the drain slot 51, fuel contained in the stop chamber 52 is unable to flow unrestrictedly therethrough and displacement of the drain valve member 46 during its movement between the closed and open positions thus causes a degree of pressurisation of the fuel in the stop chamber 52. Such pressurisation of the fuel within the stop chamber 52 as the drain valve member 46 moves towards the stop face 53 controls and/or damps the acceleration and deceleration of the valve member 46 and thus effectively limits the opening velocity thereof.

Figure 4:
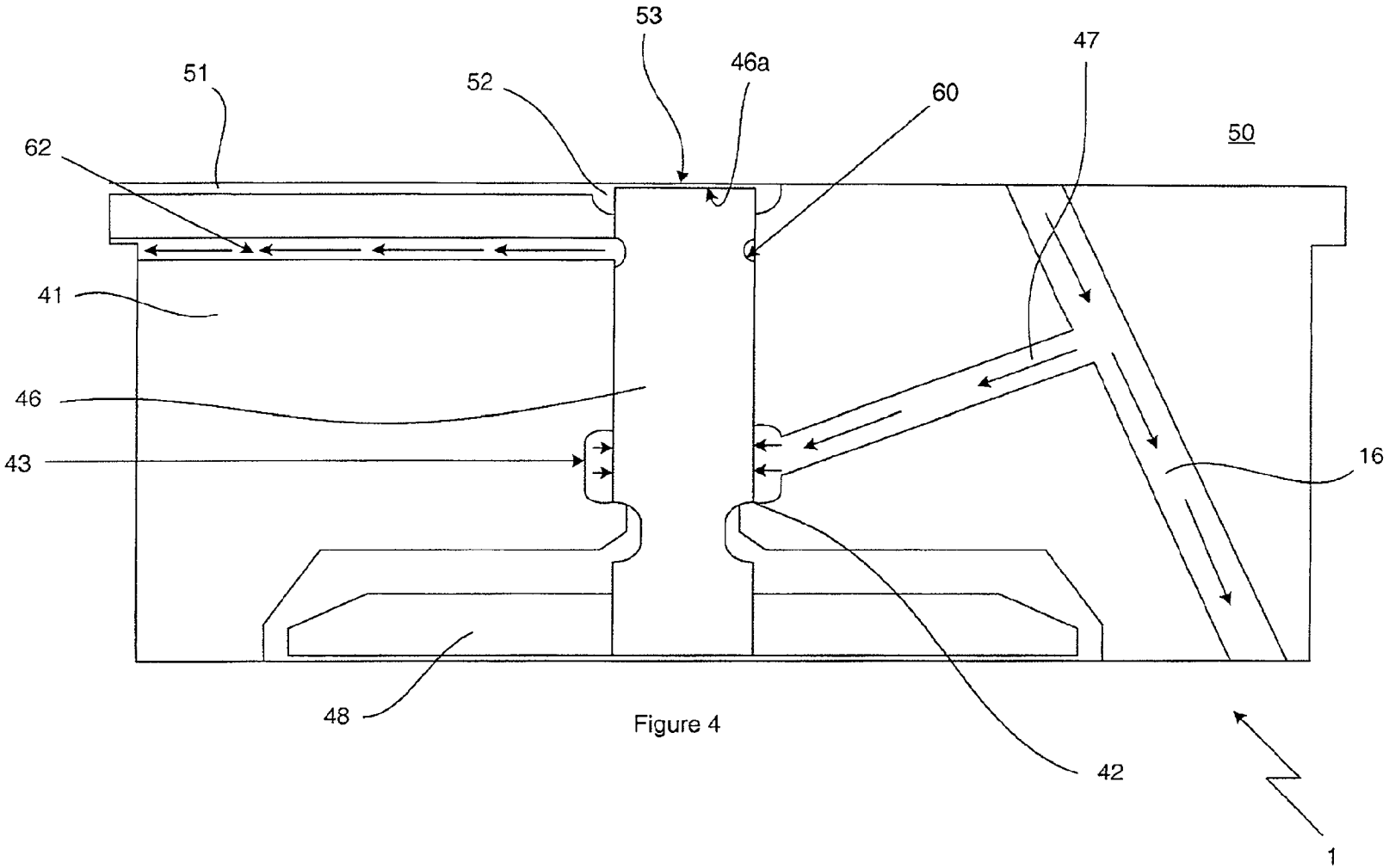
FIG. 4 is a sectional view through a valve arrangement embodying a second form of the invention.

Referring next to FIG. 4, this illustrates a potential improvement to the apparatus of FIG. 3. It will be understood by the skilled artisan that, in normal use, the stop chamber 52 receives the full volume of valve pin stem leakage past the drain valve member 46. This can be considerable at very high fuel pressures within the injector but reduces significantly as the pressure within the fuel supply passage 16 drops, for example at or during termination of injection.

There is thus a considerable variation in leakage flow into the stop chamber 52 during the operating cycle of the injector. The drain slot 51 must therefore be capable of handling consistently the combination of displacement flow due to valve motion within the drain valve bore 45 and variable valve stem leakage. The applicants have identified that it is difficult to achieve a suitable cross section configuration for the drain slot 51 which can handle this variable flow whilst providing a substantially constant damping effect on the drain valve member 46 and that it may not be possible to reduce the cross section of the drain slot 51 to provide optimum damping without further modification to the embodiment of FIG. 3.

In the embodiment of FIG. 4, therefore, the drain valve member 46 is provided with an annular gallery 60 disposed around its circumference. The gallery 60 defines a collection chamber which communicates with the low pressure fuel reservoir via a further drilling 62 disposed in the drain valve housing 41. High pressure fuel leaking between the outer surface of the valve member 46 and the wall of the bore 45 is collected in the collection chamber 60 and drained away via the drilling 62 into the low pressure fuel reservoir.

In an alternative embodiment, the annular gallery 60 on the drain valve member 46 may be replaced by an annular gallery, or circumferential groove, provided in the wall of the bore 45. Alternatively still, both the drain valve member 46 and the wall of the bore 45 may be provided with galleries to define a collection volume for fuel around the full circumference of the valve member.

As a consequence of the presence of the collection chamber 60, there is little or no fuel leakage into the stop chamber 52 past the drain valve member 46 and hence little or no pressure differential between the collection chamber 60 and the stop chamber 52. The variation in pressure of the fuel in the stop chamber 52 normally generated by valve stem leakage is therefore reduced to an insignificant or negligible level and any significant pressure variations are caused only by displacement of the drain valve member 46 between the closed and open positions.

In this embodiment, therefore, the drain slot 51 can be altered to reduce the cross sectional area further so that the flow into and out of the damping chamber 52 is further restricted to optimally control the acceleration and deceleration of the drain valve member 46. To clarify, as the drain valve member 46 moves between the closed and open positions, the fuel displaced by the drain valve member 46 is forced out of the damping chamber 52 via the drain slot 51 at a reduced rate, thus acting as a damper for the valve member 46 and reducing its opening velocity.

It will be understood that this embodiment of the invention relies on effectively de-coupling the high pressure end of the valve 46 from the low pressure, stop face end of the valve. In this manner, the significant pressure variations normally caused by variable valve stem leakage are minimised, permitting the drain slot 51 to be optimised in terms of its cross section to provide the desired level of valve damping.

Figure 5:
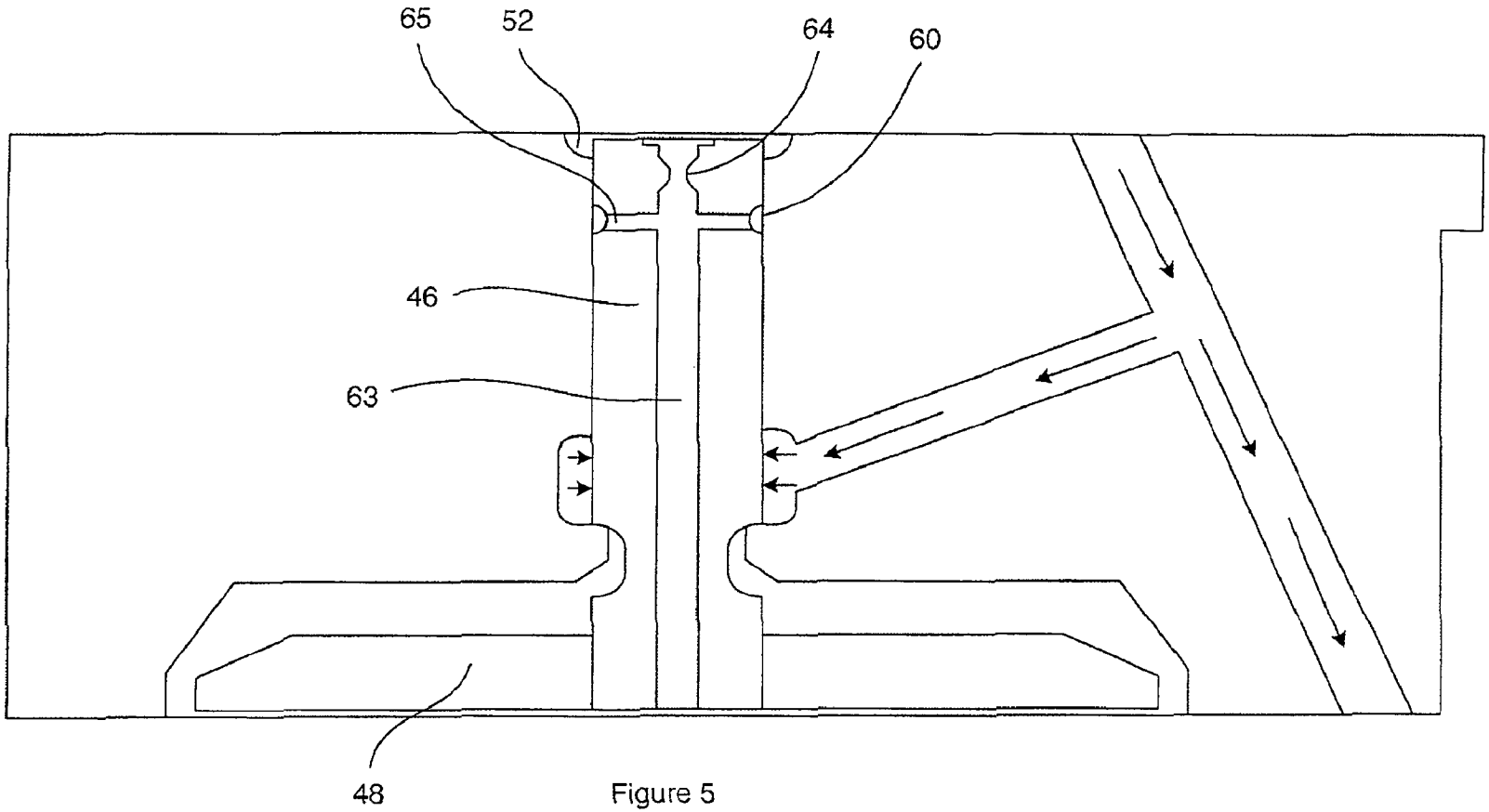
FIG. 5 is a sectional view through a valve arrangement embodying another form of the invention.

In a further alternative embodiment, the further drilling 62 in the drain valve housing 41 of the FIG. 4 embodiment may be replaced by appropriately positioned radial and axial drillings provided in the drain valve member 46. Referring to FIG. 5, an axial drilling 63 is provided centrally through the drain valve member 46. The axial drilling 63 communicates, at one end, with the damping chamber 52 through a restricted damping orifice 64 and, at the other end, with the low pressure chamber within which the armature 48 is received. A radial cross drilling 65 is provided in the drain valve member 46 and communicates with the axial drilling 63 internally within the drain valve member 46. Respective ends of the cross drilling 65 open into the collection volume 60 which, in this embodiment, is defined by an annular gallery provided in the valve member 46. The axial and radial drillings 63, 65 therefore define a communication path between the collection volume 60 and the low pressure chamber within which the armature 48 is received. In practice, this embodiment may be preferred as it may be easier to form an axial drilling in the drain valve member 46 than to form a drilling in the part (the housing 41) which forms a guide for the valve.

As described previously, the collection volume 60 may be formed in the bore 45, as shown in FIG. 5, or alternatively may be formed in the valve member 46, or in both the bore 45 and the valve member 46.

Figure 6:
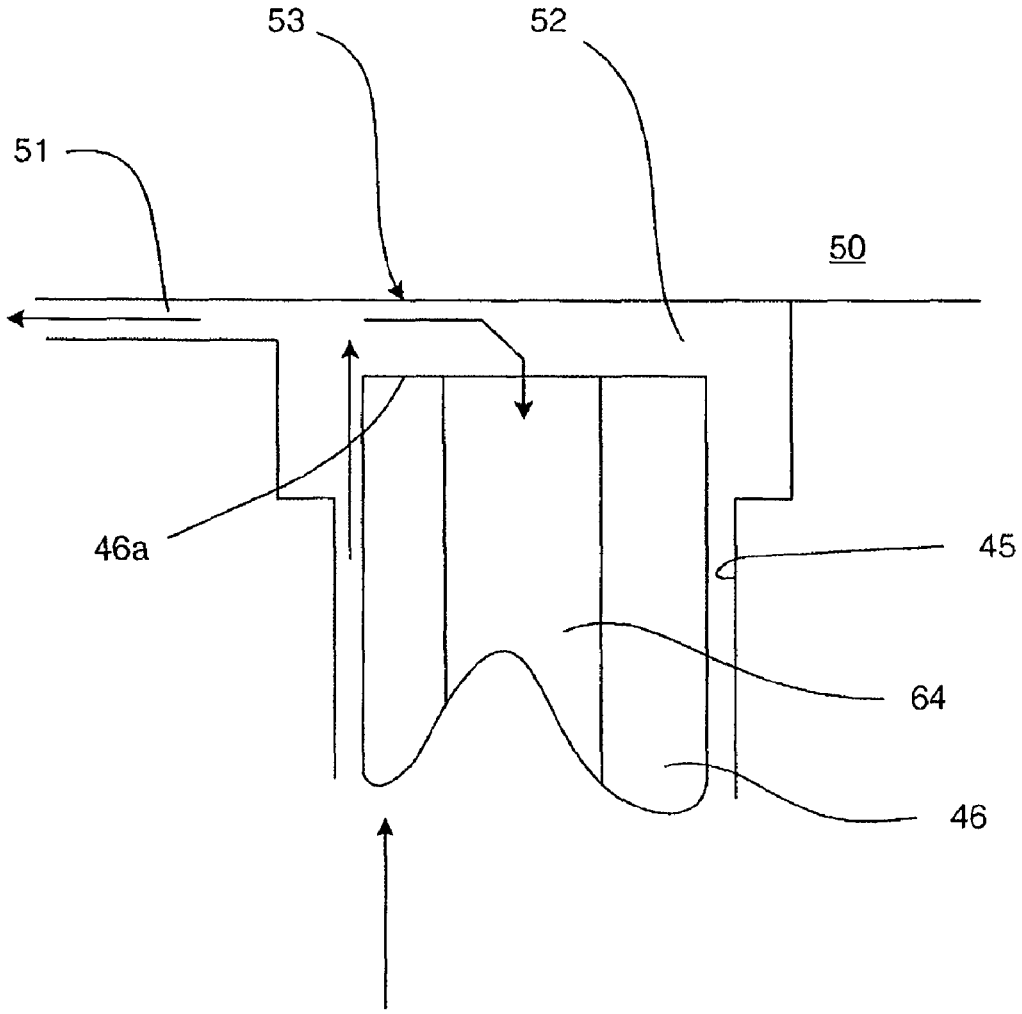
FIG. 6 is a sectional view through a valve arrangement embodying a further alternative form of the invention.

FIG. 6 illustrates a further alternative embodiment of the invention. In this embodiment, an exit path from the damping chamber 52 is provided which varies in cross section in dependence on the position of the drain valve member 46. Specifically, the drain valve member 46 is tubular, having a passage or drilling 64 which extends along the length of its central axis. The end of the drilling 64 distal to the stop face end 46*a* of the drain valve member 46 is in communication with the region surrounding the armature 48, this being in communication with the low pressure fuel reservoir.

In the illustrated embodiment, the diameter of the drilling 64 is small compared to the total diameter of the drain valve member 46 (approximately one third of the diameter) but may be selected as desired. In most cases, the diameter of the drilling 64 will be less than half of the total diameter of the valve member 46.

In FIG. 6, the drain valve member 46 is shown in the closed position in which it seats against the valve seating 42, this being termed the "full lift" position of the valve member. In this position, it will be understood that the pressure of the fuel within the supply passage 16 will be high since the exit path to the low pressure fuel reservoir is blocked by the closed drain valve member 46. Since the end of the valve member 46 distal to the stop face 53 is in communication with the high pressure fuel in the supply passage 16, valve stem leakage is relatively high.

Any fuel leaking past the valve member 46 into the stop chamber 52 is able to flow from the stop chamber to the low pressure fuel reservoir via the drain slot 51 or, when the valve member 46 is at full lift as shown, via the drilling 64 extending down the central axis of the valve member. Since the drilling is of relatively large diameter (compared to the diameter of the drain slot 51), fuel is able to drain relatively freely from the stop chamber 52 via this route.

As the drain valve member 46 moves towards the open position, the pressure of fuel applied to the high pressure end of the valve member is reduced since the drain path from the supply passage 16 to the low pressure fuel reservoir is opening. Simultaneously, however, the movement of the valve member 46 towards the stop face 53 reduces the area of the flow path to the drilling 64 until, when the valve member 46 is at zero lift (that is to say the drain valve is fully, open) the drilling 64 is closed and the only exit path for fuel in the stop chamber 52 is through the drain slot 51. At this time, however, it will be understood that since the drain valve member 46 is fully open, there is little or no pressure differential between the two ends of the valve member 46 and hence little or no stem leakage.

It can be seen, therefore, that the area of the exit path from the stop chamber 52 varies with valve position and hence with stem leakage. The arrangement can be optimised to the point whereby the effect of stem leakage on the pressure in the stop chamber 52 is negligible, the high pressure and low pressure ends of the valve member 46 again effectively being decoupled.

Unlike the embodiment of FIG. 4, the arrangement of FIG. 6 permits the occurrence of variable valve stem leakage into the stop chamber 52, but negates its effect by providing an additional flow path from the stop chamber 52, the cross section of which varies with the rate of stem leakage. As a result, the cross section of the drain slot 51 can again be optimised to ensure the correct valve velocity as the drain valve member 46 approaches the stop face 53 irrespective of stem flow.

Figure 7:
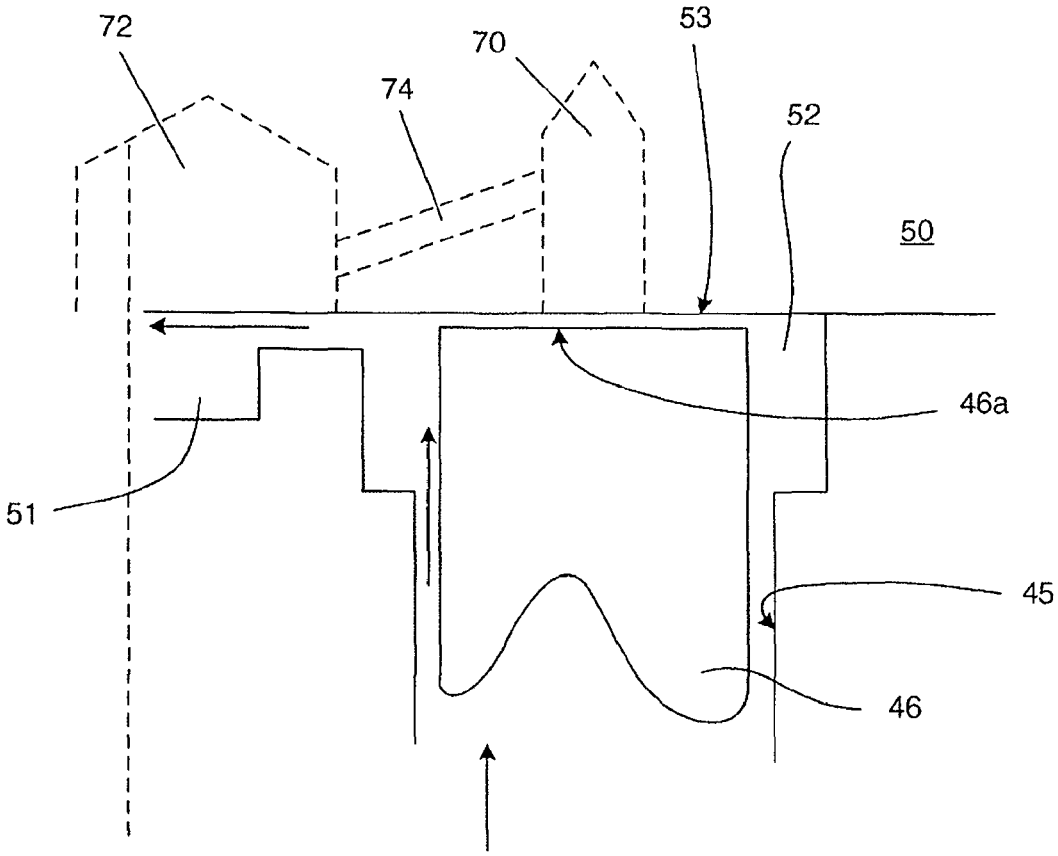
FIG. 7 is a sectional view through a valve arrangement embodying a still further form of the invention.

FIG. 7 illustrates a further alternative embodiment of the invention in which the drilling 64 through the central axis of the valve member 46 is replaced by a passage formed in the pump housing 50 between the stop chamber 52 and the low pressure fuel reservoir. The passage consists of a first sump 70 having an inlet of a first predetermined area opening into the stop chamber 52, a second sump 72 having an outlet of a second predetermined area opening into the drain slot 51 downstream of its restriction, the first and second sumps 70, 72 being connected by an intermediate passage 74 having a substantially constant diameter. In the illustrated embodiment, the outlet of the second sump 72 has a greater area than the inlet of the first sump 70, the latter having a greater area than the cross sectional area of the intermediate passage 74.

In practice, the size and shape of the first sump 70 is important as it must be selected to produce the required damping characteristic for the valve member 46. For example, if the sump opening is too small, relative to the diameter of the valve member 46, the length of the flow path between the chamber 52 and the sump 70 will be too long. Equally, if the sump opening is too large, then no damping effect will be achieved at all. The size of the sump opening is therefore selected in accordance with the size of the drain valve member 46 to give the required damping characteristics.

Operation of the embodiment of FIG. 7 is similar in principle to that of FIG. 6. At the full lift position of the drain valve member 46, when it is seated against the valve seat 42, valve stem leakage is at its highest (because the drain valve member is closed) and opening of the first sump 70 is at its greatest. Fuel leaking past the valve member 46 is therefore able to drain from the stop chamber 52 relatively freely, flowing into the second sump 72 and out to drain via the first sump 70 and the intermediate passage 74.

As the drain valve member 46 moves towards the open position, valve stem leakage is reduced but, at the same time, the opening into the first sump 70 also reduces as the valve member 46 approaches the stop face 53. When the valve member is approaching zero lift (substantially as illustrated), the annular area to the opening of the first sump 70 is reduced or restricted so that all fluid flow is forced through the drain slot 51

In this embodiment too, therefore, the effect of variable valve stem leakage is substantially negated since the ratio of stem leakage rate to drain path area can be maintained substantially constant. Once again, the cross section of the drain slot 51 can be optimised to ensure the correct valve velocity as the drain valve member 46 approaches the stop face 53.

The four embodiments described above employ different means to effectively de-couple valve stem leakage from damper flow due to displacement of the drain valve member 46. In the embodiment of FIG. 4, valve stem leakage into the damping chamber 52 is reduced or substantially eliminated by the provision of the collection chamber 60 and the cross drilling 62 from the drain valve bore 45 to the low pressure fuel reservoir, which provides a drain path for the high pressure fuel.

In the embodiments of FIGS. 6 and 7, on the other hand, valve stem leakage into the damping chamber 52 is permitted but its adverse effect on valve damping is reduced or substantially negated by providing a drain path to a stable (low) pressure region, the area of which is varied as the position of the drain valve member 46 varies between the full and zero lift positions. The result is that valve damping is increased as the valve member approaches zero lift.

In each case, a good compromise can be achieved between relieving valve stem leakage and limiting impact velocity of the drain valve member 46 with the stop face 53.

It can be seen that the present invention provides a particularly simple yet highly effective solution to the problem of excessive opening velocity of the injector drain valve 46 (spill valve). By using the stop chamber 52 adjacent the stop face 53 of the drain valve bore 45 as a damping chamber, and the end of the valve member 46 itself as the piston of the damper, and by reducing the cross sectional area of the existing drain slot, the opening velocity of the drain valve member 46 can be controlled more easily. A significant reduction in the velocity of the drain valve member 46 in the opening direction can be achieved, thereby providing an advantageous improvement in the safety margin of the armature/pin interface.

By way of example, a typical size of the drain slot 51 in the embodiments of FIGS. 4 to 7 is 4 mm×0.05 mm (i.e. 0.2 $mm^2$), in comparison with the drain slot of FIG. 2 which is typically 4 mm×0.3 mm (i.e. 1.2 $mm^2$). Thus, the cross sectional area of the drain slot 51 in embodiments of the present invention may typically fall within the range of 15-20% of the cross sectional area of the drain slot 51 in the known arrangement of FIG. 2.

Furthermore, it has been identified that by reducing the opening velocity of the drain valve 46, hydraulic noise present at the end of injection may be significantly reduced and the resulting reduction in spill rate permits high speed post injections of fuel at close separation to be achieved more easily.

In addition, it will be appreciated that these advantages can be achieved without recourse to further match grinding operations or the provision of additional parts or components since the elements of the damper, being the stop chamber 52 and the drain valve member 46 itself, are already present in the existing injector. This makes the solution highly cost effective.

It will also be appreciated that variations and/or improvements may be made to the invention without departing from the scope thereof, which scope is defined by the claims appended hereto.

For example, although the configuration of the drain slot 51 must be optimised to provide the necessary damping effect, which may be achieved through the provision of a restriction in the cross section of the slot, consideration must also be given to providing a flow area that is sufficient to allow fuel to be drawn into the stop chamber 52 through the drain slot 51 in order to permit the drain valve member 46 to move away from the stop face 53 and towards its seat 42, i.e. towards the closed position. This ingress of fuel into the stop chamber 52 serves to charge the stop chamber 52 in preparation for the next opening movement of the drain valve member 46.

In this regard, it is also envisaged that, in some circumstances, it may be desirable to employ a shaped orifice having a discharge coefficient which differs between inflow and outflow. Alternatively, or in addition, a one way valve or the like may be included to restrict fuel flow out of the stop chamber 52, whilst permitting relatively unrestricted flow into the chamber 52.

Although the valve arrangements of FIGS. 3 to 7 are described above as separate embodiments, it will be understood by those skilled in the art that the features thereof may be used individually or in combination with one another in order to achieve the desired damping effect on the drain valve member 46, which may differ in dependence on valve operating conditions.

The invention claimed is:

1. A fuel injection apparatus (1) for an internal combustion engine comprising:

a fuel supply passage (16);

a valve arrangement for controlling fuel pressure within the fuel supply passage (16), the valve arrangement including a valve member (46) movable between an open position in which the fuel supply passage (16) communicates with a low pressure fuel drain and a closed position in which communication between the fuel supply passage (16) and the low pressure fuel drain is prevented; and damping means (51, 52) for controlling and/or damping movement of the valve member between the closed and open positions, wherein the valve member (46) is movable within a bore (45) disposed in a housing (41), the bore (45) defined about a longitudinal axis, the bore (45) being closed at one end thereof, wherein the damping means comprises a damping chamber (52) defined between the closed end (53) of the bore (45) and the valve member (46), the damping chamber (52) having an exit or outlet (51) for controlling the rate of fuel flow into and/or out of the damping chamber (52), thereby to provide a damping effect on the valve member (46);

characterized in that one of the circumferential surface of the bore or the surface of the valve member that faces the circumferential surface of the bore (45) defines a collection means (60, 62), said collection means axially located between the fuel supply passage (16) and the damping chamber (52) for hindering or substantially preventing fuel leakage between the valve member (46) and the bore (45) from entering into the damping chamber (52), the collection means comprising a volume (60) for collecting fuel leaking between the valve member (46) and the bore (45), wherein the volume (60) is in continuous fluid communication with the low pressure fuel drain both when the valve member (46) is in the open position and when the valve member (46) is in the closed position.

2. A fuel injection apparatus as claimed in claim 1, wherein the exit or outlet comprises a drain slot (51) and includes means for hindering or restricting flow of fuel from the damping chamber (52).

3. A fuel injection apparatus as claimed in claim 2, wherein the means for hindering or restricting flow of fuel from the damping chamber (52) comprises a narrowing or a restriction in the drain slot (51).

4. A fuel injection apparatus as claimed in claim 3, whereby, in use, movement of the valve member (46) towards the closed end (53) of the bore (45) causes the pressure of fuel in the damping chamber (52) to increase thereby to limit the velocity of the valve member (46) within the bore (45).

5. A fuel injection apparatus as claimed in claim 1, wherein the volume comprises an annular collection chamber (60) formed in the valve member (46).

6. A fuel injection apparatus as claimed in claim 1, wherein the volume comprises an annular recess (60) formed in the wall of the bore (45).

7. A fuel injection apparatus as claimed in claim 1, wherein the volume (60) communicates with the low pressure drain via a drilling (62; 63, 65).

8. A fuel injection apparatus as claimed in claim 7, wherein the drilling (62) is provided in the housing (41).

9. A fuel injection apparatus as claimed in claim 7, wherein the drilling (63, 65) is provided in the drain valve member (46).

10. A fuel injection apparatus as claimed in claim 1, wherein pressure variation within the damping chamber (52) due to fuel leakage past the valve member (46) is effectively decoupled from the pressure variation within the damping chamber (52) due to movement of the valve member (46) between the closed and open positions.

11. A fuel injection apparatus as claimed in claim 1, wherein fuel contained within the damping chamber (52) acts to damp or slow movement of the valve member (46) between the first and second positions, thereby reducing the spill rate of the injector.

* * * * *